US010181272B2

(12) United States Patent
Krauss et al.

(10) Patent No.: US 10,181,272 B2
(45) Date of Patent: Jan. 15, 2019

(54) LABEL FOR A CONTAINER WHICH IS IN A NUMBER OF PARTS OR CAN BE DIVIDED INTO A NUMBER OF PARTS

(71) Applicant: Schreiner Group GmbH & Co. KG, Oberschleissheim (DE)

(72) Inventors: Stefan Krauss, Munich (DE); Maximilian Jaeger, Munich (DE)

(73) Assignee: Schreiner Group GmbH & Co. KG, Oberschleissheim (DE)

( * ) Notice: Subject to any disclaimer, the term of this patent is extended or adjusted under 35 U.S.C. 154(b) by 0 days.

(21) Appl. No.: 15/323,554

(22) PCT Filed: Jul. 28, 2015

(86) PCT No.: PCT/EP2015/067257
§ 371 (c)(1),
(2) Date: Jan. 3, 2017

(87) PCT Pub. No.: WO2016/016232
PCT Pub. Date: Feb. 4, 2016

(65) Prior Publication Data

US 2017/0154548 A1 Jun. 1, 2017

(30) Foreign Application Priority Data

Jul. 29, 2014 (DE) ..... 10 2014 110 738

(51) Int. Cl.
*G09F 3/02* (2006.01)
*G09F 3/00* (2006.01)
(Continued)

(52) U.S. Cl.
CPC ..... *G09F 3/0288* (2013.01); *A61J 1/18* (2013.01); *G09F 3/0292* (2013.01);
(Continued)

(58) Field of Classification Search
CPC ..... G09F 3/0288; G09F 3/0292; G09F 2003/0273; A61J 1/18; A61J 2205/30
See application file for complete search history.

(56) References Cited

U.S. PATENT DOCUMENTS 4,724,973 A 2/1988 Shah
5,048,711 A * 9/1991 Weiss ..... B65D 41/0471 116/309
(Continued)

FOREIGN PATENT DOCUMENTS

DE 10 2004 018 834 A1 9/2005
DE 600 31 659 T2 2/2007
(Continued)

OTHER PUBLICATIONS

International Search Report of PCT/EP2015/067257, dated Sep. 30, 2015.

*Primary Examiner* — Gary C Hoge
(74) *Attorney, Agent, or Firm* — Collard & Roe, P.C.

(57) ABSTRACT

A label for a medication container that is in multiple parts or can be divided into multiple parts has a first label section, to be attached to a first container part, and a second label section, to be attached to a second container part. The first label part serves for being wrapped completely around the first container part, more than once, and is disposed within a first basic surface area region of the basic surface area of the label, intended to be wrapped around the first container part. The second label section includes a spare label having a first sub-section and a second sub-section. The first sub-section is disposed in the first basic surface area region, and the second sub-section is disposed in a second basic surface area region, which is intended for being attached to a second container part. The label is configured in such a manner that when the first and the second label section are pulled apart to open a container around which the label is adhesively
(Continued)

Figure 1:
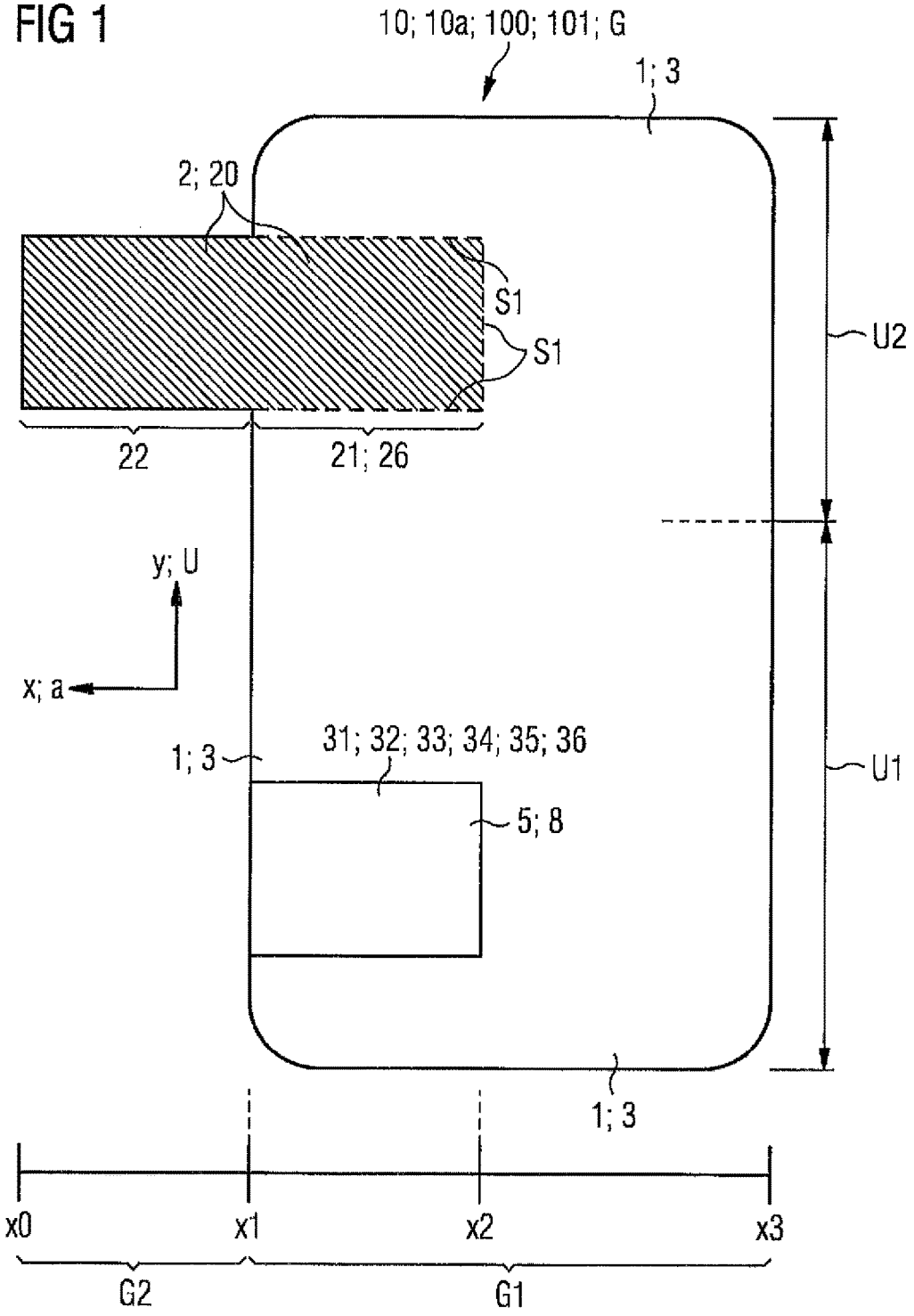

applied, the first and the second label section tear apart from one another, and the first sub-section of the spare label forms a grip tab for pulling the spare label off a remainder of the second label section and/or off the second container part.

20 Claims, 7 Drawing Sheets

(51) Int. Cl.
*G09F 3/03* (2006.01)
*A61J 1/18* (2006.01)
*G09F 3/10* (2006.01)

(52) U.S. Cl.
CPC ..... *G09F 3/0341* (2013.01); *G09F 3/10* (2013.01); *A61J 2200/72* (2013.01); *A61J 2205/30* (2013.01); *G09F 2003/0272* (2013.01); *G09F 2003/0273* (2013.01)

(56) References Cited

U.S. PATENT DOCUMENTS 5,257,704 A 11/1993 Gutt
5,317,987 A 6/1994 Mueller
5,329,713 A * 7/1994 Lundell ..... G09F 3/0288 40/310
5,506,015 A * 4/1996 Frederiksen ..... A61J 1/1412 206/807
6,276,725 B1 * 8/2001 Laurash ..... G09F 3/0292 206/459.1
6,385,878 B1 5/2002 Key
7,141,286 B1 * 11/2006 Kessler ..... A61M 5/3202 428/41.8
8,832,978 B2 9/2014 Seidl
2003/0031598 A1 * 2/2003 Stevens ..... B01L 3/5453 422/549
2003/0047937 A1 * 3/2003 Chaduc ..... G09F 3/0292 283/81
2007/0176410 A1 * 8/2007 Unglert ..... G09F 3/0292 283/67
2008/0150275 A1 * 6/2008 Raistrick ..... G09F 3/0288 283/81
2009/0143745 A1 * 6/2009 Langan ..... G09F 3/0288 604/189
2009/0246427 A1 * 10/2009 Hincks ..... G09F 3/0288 428/34.1
2009/0314775 A1 * 12/2009 Dietrich ..... G09F 3/0292 220/212
2013/0298435 A1 11/2013 Silvano
2016/0332789 A1 * 11/2016 Yerecic ..... B65D 55/024

FOREIGN PATENT DOCUMENTS

DE 10 2011 111 921 A1 2/2013
EP 1 044 698 A1 10/2000
EP 1 169 075 B1 11/2006
EP 1 857 992 A2 11/2007
EP 2 003 064 B1 7/2010
EP 2 369 569 A2 9/2011
EP 2 654 032 A1 10/2013
FR 2 784 779 A1 4/2000
WO 91/06853 A1 5/1991
WO 2005/091255 A1 9/2005
WO 2008/083926 A1 7/2008

* cited by examiner

LABEL FOR A CONTAINER WHICH IS IN A NUMBER OF PARTS OR CAN BE DIVIDED INTO A NUMBER OF PARTS

CROSS REFERENCE TO RELATED APPLICATIONS

This application is the National Stage of PCT/EP2015/067257 filed on Jul. 28, 2015, which claims priority under 35 U.S.C. § 119 of German Application No. 10 2014 110 738.1 filed on Jul. 29, 2014, the disclosure of which is incorporated by reference. The international application under PCT article 21(2) was not published in English.

The invention relates to a label for a container that is in multiple parts or in any case can be divided into multiple parts, particularly a container for storing, administering, withdrawing and/or accommodating a medication and/or a liquid. The invention furthermore relates to a container provided with such a label.

In the field of labeling of objects, particularly of multi-part pharmaceutical containers, it is known to structure labels in such a manner that during first-time use or first-time opening of the container that is in multiple parts or in any case can be divided into multiple parts, as intended, irreversible changes of the label occur, in order to make product counterfeiting, unauthorized re-use or further sale of a container that has already been used and/or of its contents more difficult. Such safety features serve as proof of first opening, so that the buyer or user of an article can easily determine whether he/she has an original product that comes from the original manufacturer and is in its original condition in his/her hands, or a counterfeit product. Particularly in medicine and pharmacy, it is important to draw the attention of the vendor, the doctor, the medical personnel, and the patient to any possible attempt at manipulation and any product forgery or trademark deception, by means of suitable labeling, in the handling of medication containers, in order to exclude the possibly significant health risks for the patient. By means of suitable labeling, it must furthermore be ensured that the medication or the container contents have not become outdated and unusable, contrary to the possibly incorrect marking.

The multi-part medication containers that come into consideration for the invention are, for example, syringes, injection pens, multi-part ampoules, vials, or, in general, multi-part containers. For example, syringes and injection pens contain a cap, in each instance, which must be pulled off before use. Likewise, there are one-part containers that are in one part in their original delivered state, but must be divided into two parts before use, as intended; examples are break-apart ampoules that must be opened by striking off an ampoule head, or other one-part or multi-part vessels, in which some other external seal must be removed, a cap must be pulled off or some other closure element must be released. The invention can also be considered for these containers which are not originally in one part. In the following text, no distinction will be made any longer between multi-part containers and one-part containers that can be divided into multiple parts before use, but rather, to represent them and for the sake of brevity, only multi-part containers will be discussed. However, the containers being considered have in common that in order to open them, two container parts must be separated from one another in order to gain access to the container contents. Before opening, however, the two container parts can either be separate container parts that have been mounted on one another, or, alternatively, two sub-regions of a container that is in one part at first but must be divided into two separate container parts. In the latter case, the two container parts are two sub-regions of a one-part container.

Medications or pharmaceuticals, in particular, for example liquid medication solutions, suspensions, liquids, powders or other formulations must be shielded not just from the ambient air but above all from contact with body tissue and pathogens before their first-time use. Also, aside from pharmaceutical containers, containers exist in which a container closure, for example a cap or a lid, must be separated and/or removed from the remainder of the container or its main body, by means of a pulling movement, in order to open the container. For example, a closure cap first has to be removed from a syringe or an injection pen in order to be able to withdraw and administer the medication solution.

Another aspect that plays a role in labeling of containers, particularly for medicinal products, is the use of documentation labels with which administration of a medication is documented, for example in a patient record or on a syringe with which part of the medication liquid is withdrawn from a vial and then administered. Such documentation labels are increasingly integrated into the label as a whole, with which the medication container is labeled, as a subsidiary label or spare label. For example, such a spare label is accommodated in part of the surface area of the label as a whole, or multi-layer labels having multiple, differently punched material webs are used, for example having multiple plastic films that lie one on top of the other, each having their own punch pattern.

In spite of the labels that have been in use until now for multi-part containers, particularly for medication containers, for example of the types listed above, development potential exists with regard to handling of such spare labels; in particular, after the medication container or, in any case, its label has been opened, additional manual actions are frequently required first, before the physician, the medical personnel or the patient has access to the integrated spare label and can remove this from the rest of the label and use it some other way.

It is the task of the present invention to make available a label for a multi-part container, particularly for a multi-part medication container, wherein the label not only achieves more effective proof of first opening, but rather, at the same time, also facilitates and simplifies handling of a spare label. In particular, the label is to be structured in such a manner that its spare label is directly accessible after the container has been opened, and can be handled as conveniently as possible, without prior additional manual actions being required for this purpose. Furthermore, a multi-part container provided with such a label, particularly one for pharmaceuticals, is supposed to be made available, where the spare label is more easily accessible when the container is put into use, and, at the same time, suitable proof of first opening is achieved.

This task is accomplished by means of a label according to the invention.

Figure 2:
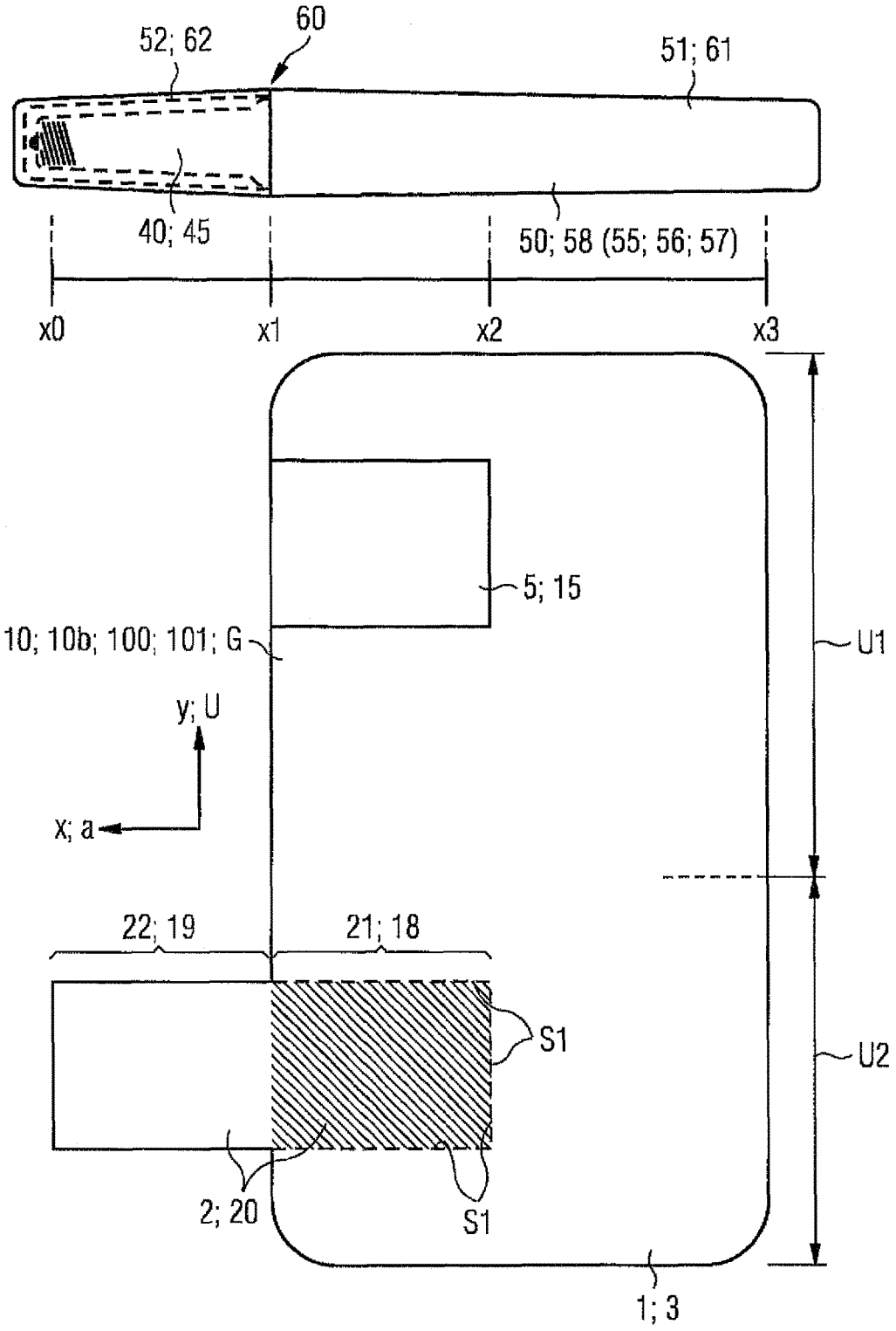
Figure 3:
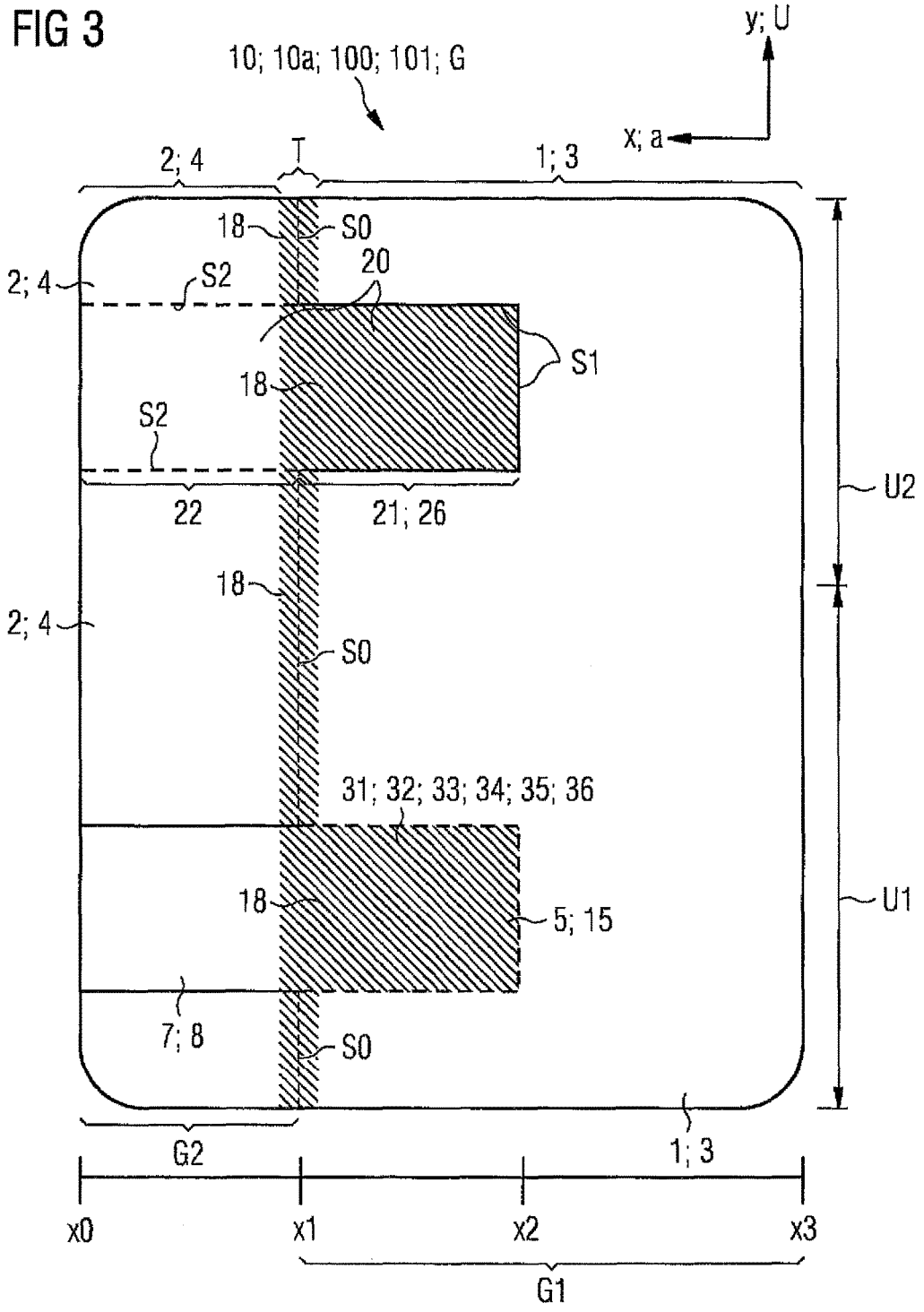
Figure 4A:
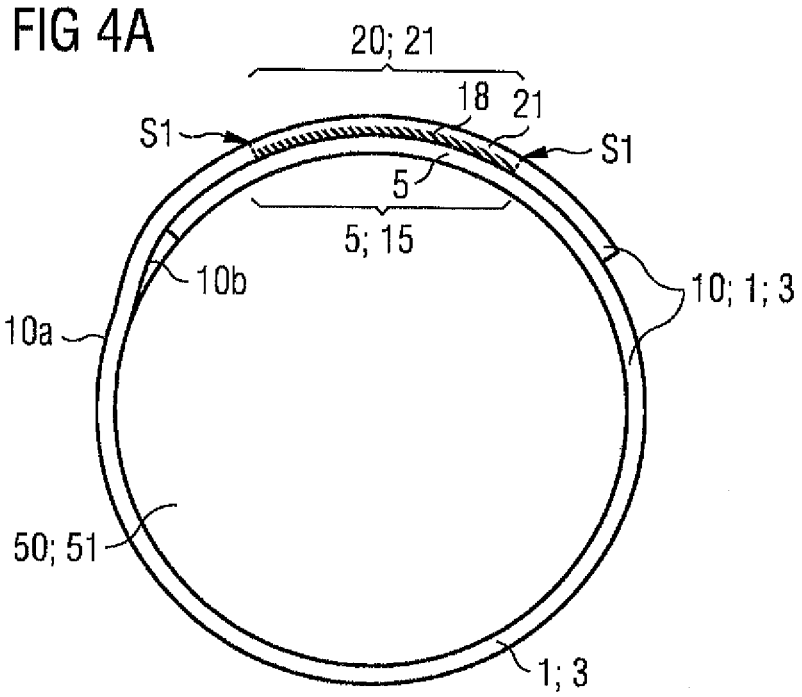
Figure 4B:
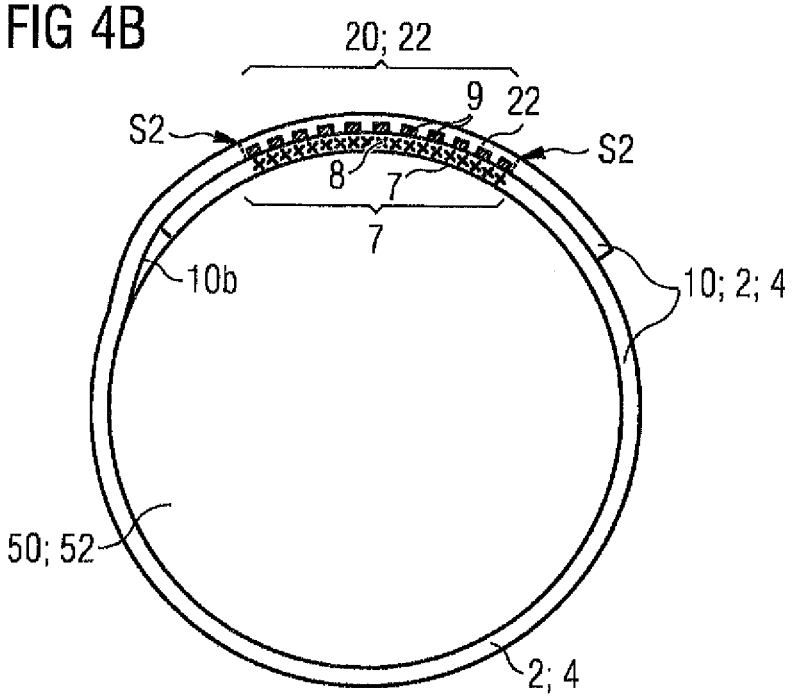
Figure 5:
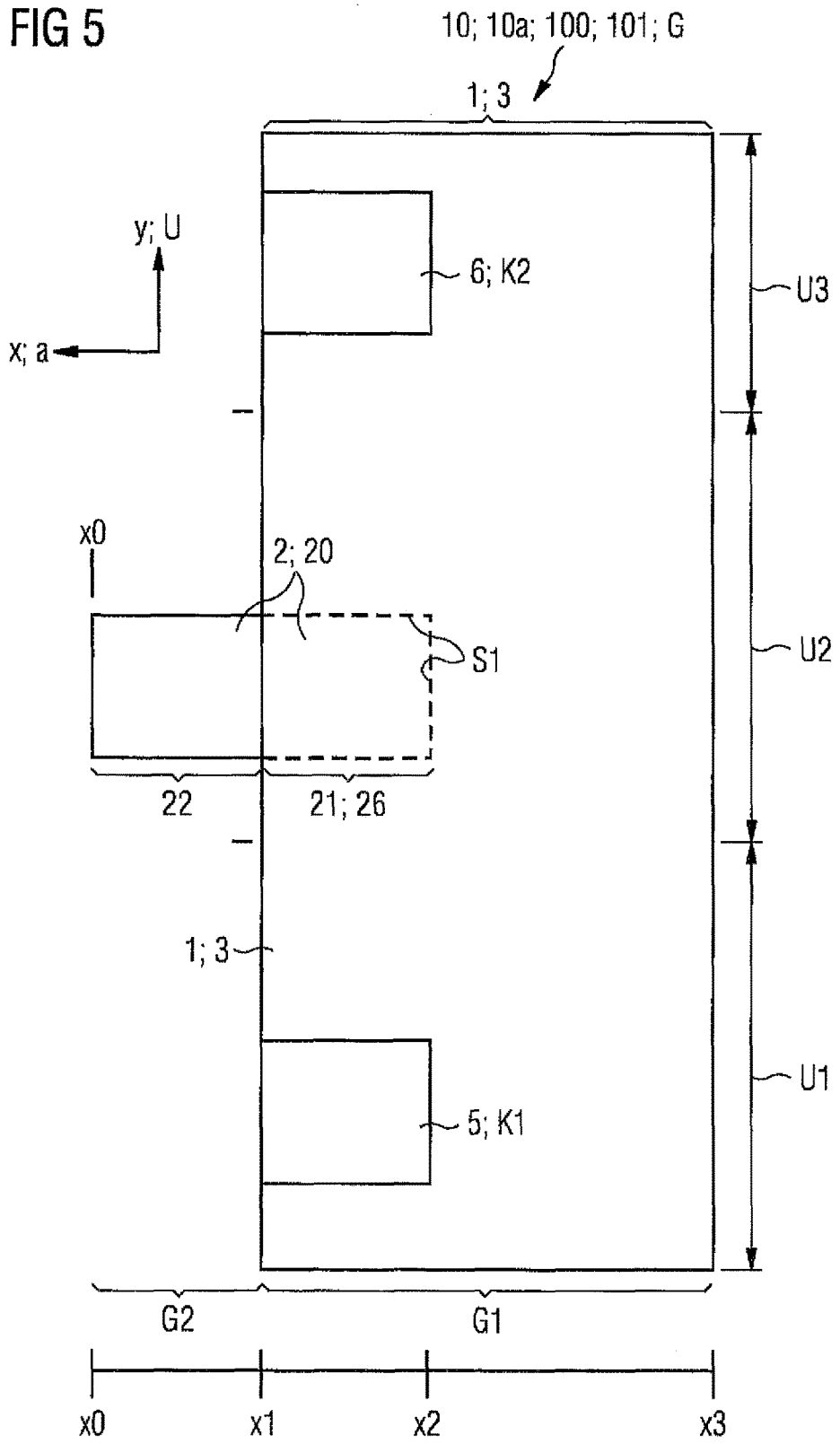
Figure 6:
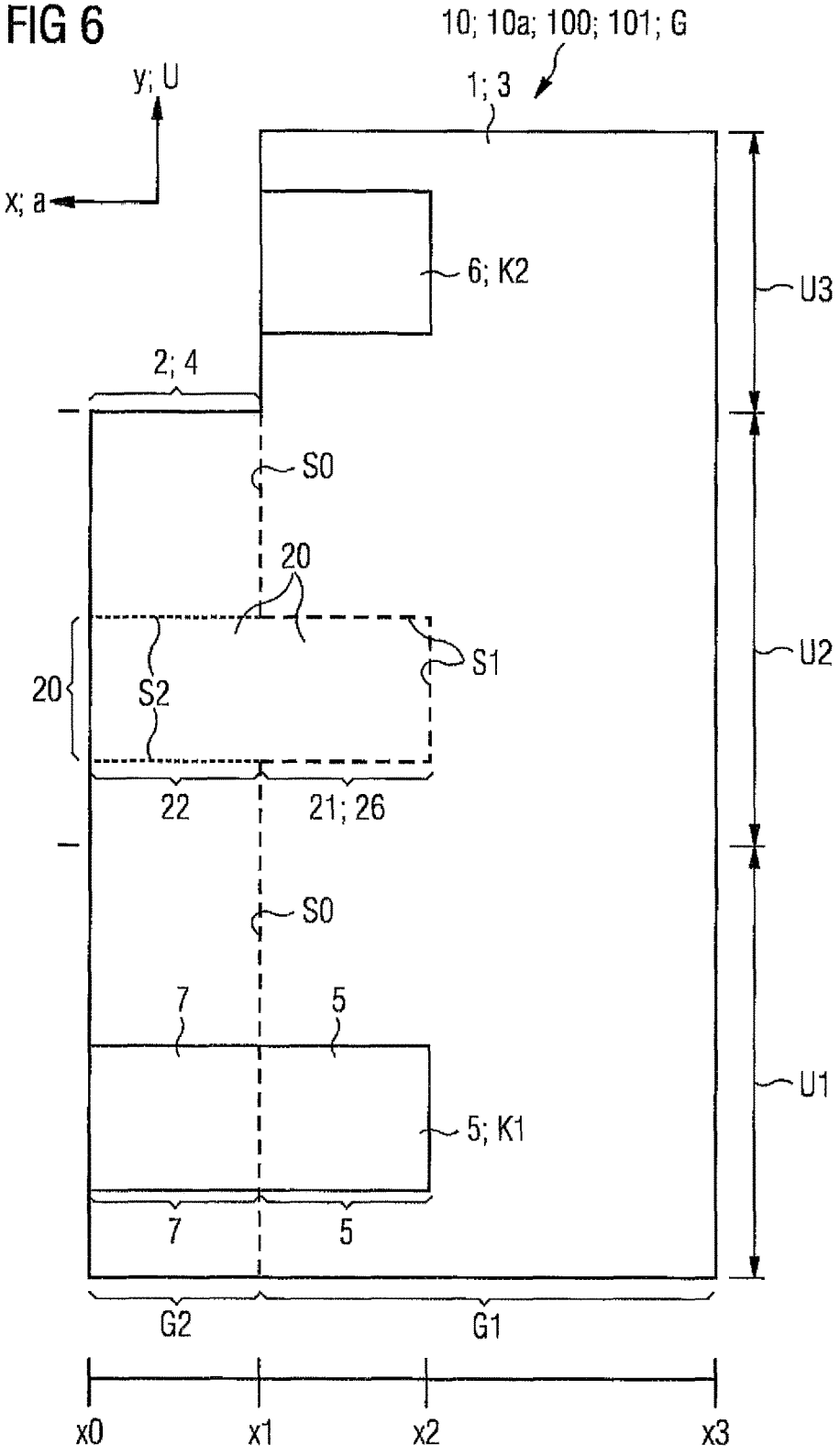
Figure 7:
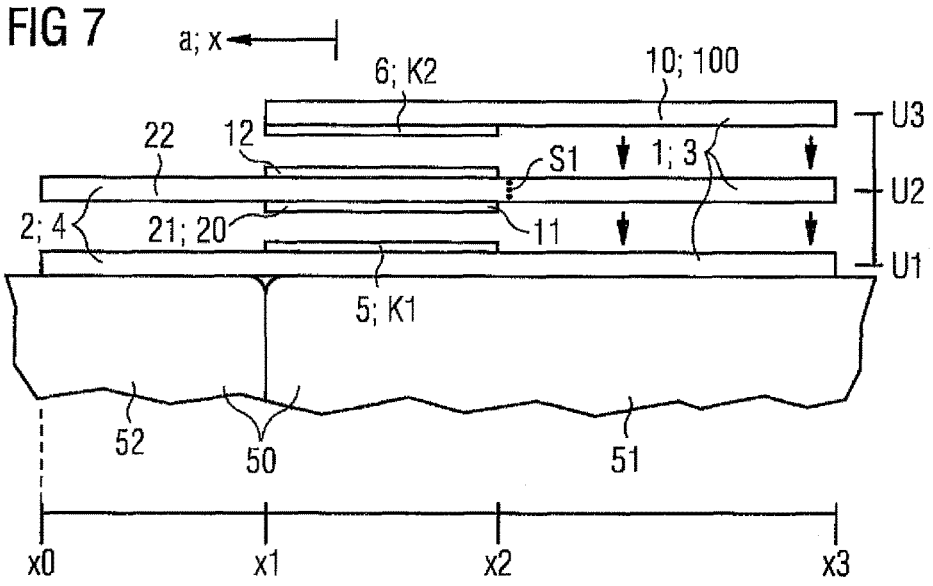
Figure 8:
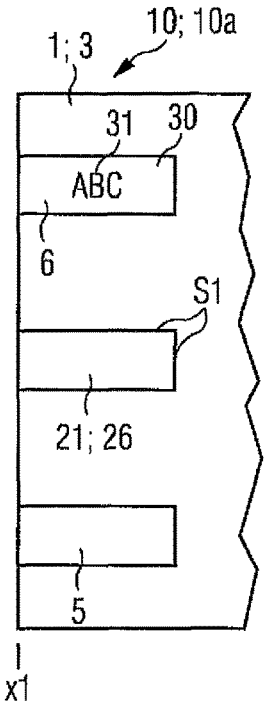
Figure 9:
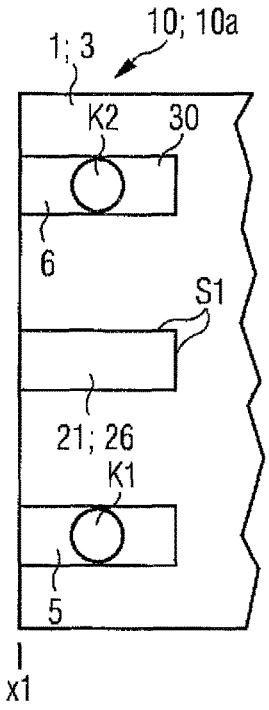
Figure 10:
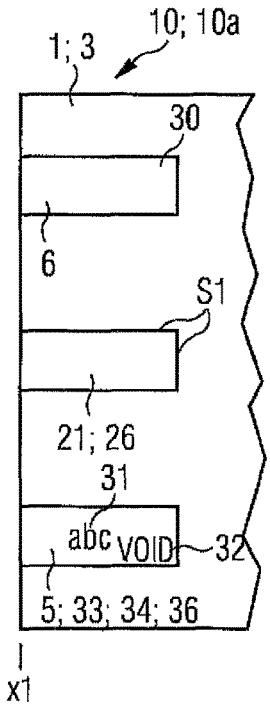

Some exemplary embodiments will be described below, making reference to the figures. These show:

FIG. 1 a schematic top view of the top of a label configured according to a first exemplary embodiment, FIG. 2 a schematic top view of the underside of the label from FIG. 1 and a container around which it is to be adhesively applied, FIG. 3 a schematic top view of a label according to a second exemplary embodiment, FIG. 4A a schematic cross-sectional view of a container around which a label according to FIGS. 1 to 3 has been adhesively applied, represented as a sectional view at the level of the first sub-section of the spare label, FIG. 4B a schematic cross-sectional view of a container around which a label according to FIG. 3 has been adhesively applied, represented as a sectional view at the level of the second sub-section of the spare label, FIG. 5 a schematic top view of a label according to a third exemplary embodiment, which serves for being wrapped more than twice around at least a first container part, FIG. 6 a schematic top view of a label according to a fourth exemplary embodiment, which serves for being wrapped at least twice around both a first and a second container part of a container, FIG. 7 a schematic cross-sectional view of a label adhesively applied to the outer circumference of a container, and FIGS. 8 to 10 different exemplary embodiments having two functional areas that are at first separated from one another by the spare label.

The label according to the embodiments of this application is intended for a multi-part container, or, in any case, a container that can be divided into at least two parts, as intended, for example a syringe, an injection pen, a vial, an ampoule or another multi-part container for medicinal, pharmaceutical or other products, in which containers a container closure, for example a lid or a cap, is pulled off or removed from the remaining container part in some other way, in order to open the container.

The label has a first label section to be attached to a first container part, for example a main body or the actual container, as well as a second label section to be attached to a second container part. The label is particularly intended for such containers in which the second container part is the cap, the lid or some other container closure, which can be pulled off from the first container part using a pulling movement, for example. The label is therefore particularly well suited for two-part containers, for example for those in an elongated pen shape. The label is furthermore configured as a wrap-around label, in order to be able to optionally wrap it more than once around the first container part, the second container part or both container parts, so that the label overlaps on at least one of the container parts, i.e. it comes to lie on itself. For example, the main body of the container, i.e. the actual container without the closure cap, can have the first label section mentioned above completely wrapped around or adhesively applied to it more than once. However, depending on the type of embodiment, the container closure can also have a second label section wrapped around it more than once, in addition. However, at least the first label section is structured in the manner of a wrap-around label. The two label sections are configured in one and the same material web, for example implemented by one and the same plastic film; the basic surface area of this web is then divided into the first label section and the second label section, and, if applicable, even further sections by means of suitable perforations, punches or other separation lines or weakening lines. The first or second label section is the one that is intended, as explained above, for being attached to the first or second container part, respectively. The first label section therefore refers to the section that remains on the first container part, for example the main body of the container, after the container has been opened, i.e. after the two container parts are separated from one another. Correspondingly, the second label section is the one that remains or is affixed to the second container part, after the container has been opened, as intended. It is decisively determined by the course of the separation lines or weakening lines within the basic surface area of the label, along which the label is torn open and severed, as intended, when the container which the label is intended to label is opened, what region of the basic surface area of the label belongs to the first or second label section. In this regard, at least two separate label sections are formed, which were previously united in the same material ply. Therefore everything that remains on the second container part after a labeled container has been opened as intended belongs to the second label section.

According to this application, the second label section comprises a spare label that is configured in the same material web as the first label section, and also a remaining part of the second label section, if it is present, depending on the embodiment. In this way, the label according to the invention already differs from conventional labels, which, if they contain a spare label, are generally structured in such a manner that the spare label remains on the main body of the medication container after the container has been opened, until it is manually pulled off the container. In contrast, in this application a label is proposed, the spare label of which, as intended, does not remain on the main body of the container, but rather remains on the container closure or the second container part when this part is separated from the first container part.

Such a label structure might appear absurd at first glance, because the container closure normally possesses a much smaller dimension than the actual vessel and therefore appears to be far less suitable for accommodating a label part that can be inscribed or used in some other way, even if it is only a smaller documentation label, than the much larger first container part. Handling of a label, the spare label of which does not remain on the first container part or the main body, which is filled with the medication, the liquid or the other container contents, appears to be implausible, at first glance; not only because of the often larger circumference surface of this first container part for accommodating a spare label, but rather also because the filled first container part is used, but the closure part can already be disposed of or misplaced earlier.

According to this application, it is provided that the spare label is partly disposed in a basic surface area of the label, which area is intended for being wrapped around the first container part, and partly disposed in a second basic surface area that is intended for being wrapped around the second container part. The commercially available, standardized medication containers used in medicine, such as syringes, injection pens, vials, and ampoules, etc., are usually containers around which a label is wrapped, for example containers having a cylindrical, particularly a circular-cylindrical, but often also a conical circumference surface, or one shaped in some other way. The circumference surface, at least of the main body, i.e. of the actual container part, which is referred to as the first container part here, possesses a constant or, in any case, a hardly varying diameter along a first, axial direction, which forms the axis of symmetry of the container part and, if applicable, its circumference surface, over a major part of its height. Alternatively, the circumference surface can be formed to be conical or some other shape over a major portion of its height, specifically in such a manner that a label can be wrapped around the circumference surface. The container or other article therefore possesses a circumference surface that can be labeled, particularly can have a wrap-around label wrapped around it. In contrast, the cap for the syringe or the injection pen or the other container closure often possesses a different radius, which is smaller, for example, than that of the main body or which possesses an even greater conical inclination.

The container closure is usually offset in the axial direction relative to the circumference surface of the actual first container part; in the simplest case, the circumference surfaces of the first and of the second container part abut one another or are separated from one another by means of a face-side ring surface that runs approximately transverse to the axial direction, if applicable with an air gap or a constriction in between. Commercially available labels are therefore coordinated with the circumference surfaces of standardized medication containers, or at least of their main body, which surfaces are dimensioned uniformly with regard to radius, circumference, and height.

As a consequence of the radial symmetry of practically all medication containers such as a syringe, an ampoule, a vial, an injection pen, etc., the labels intended for labeling them possess not only specific minimum dimensions, for example in order to cover the circumference surface of a first container part in the circumference direction as well as the axial direction as completely as possible, something that translates into the form of minimum dimensions of the label along two directions, which correspond to the axial direction and the circumference direction.

Furthermore, the rotation symmetry of practically all conventional medication containers has the result that the basic surface area of the label, if the label is to be adhesively applied not only to the first but also to the second container part, naturally divides into a first basic surface area region for being wrapped around the first container part, and a second basic surface area region for being wrapped around the second container part. If, for example, the circumference surface of a first container part possesses a certain height in the axial direction, then the label intended for it also possesses a comparably large dimension in a first direction, which corresponds to the axial direction of the article, so that the available inscription surface on the circumference surface of the first container part is utilized as completely as possible, i.e. adhesively covered. In the case of a label that is even taller than this dimension of the first container part, the lower part of the label, for example, forms this first basic surface area region that is intended for adhesively applying the label and wrapping it around the first container part, while the remaining surface area region of the label, which is disposed above it, then forms the other, second basic surface area region for being wrapped around and adhesively applied to the second container part. This division of the label surface into a first and a second basic surface area region, which naturally results from the outer circumference surface of common medication containers, having rotation symmetry, is generally also marked by a separation line that runs between them. Conventionally, the separation line or weakening line usually crosses the basic surface area of the label completely, from one label edge to the opposite label edge, and runs between the two edges as a straight line or essentially as a straight line. At least the total course of the separation line, if one only connects the perforation punches, holes or the like lined up along the separation line with one another, usually results in a straight line between two opposite edges of the basic surface area of the label, so that this separation line surrounds the transition between the two container parts, as a ring-shaped line, on the dispensed label. In the case of such labels, there is therefore no difference, with regard to the surface area division within the basic surface area of the label, between the basic surface area regions of the label that are intended to be attached to a respective container part, and those basic surface area regions that are intended to be wrapped around the respective container part, because a sub-section of a first label section, which surrounds a first container part, is normally also attached to this part and remains on this first container part even after the container has been opened.

According to this application, however, it is provided that a spare label, which is part of the second label section and is therefore intended to be attached to the container part of a container (specifically already before the container is opened, but particularly also after it is opened), has two sub-sections, wherein the second sub-section is intended to cover the second container part, whereas the first sub-section of the spare label is intended to cover the first container part. The spare label thereby comprises a first and a second sub-section, wherein the first sub-section is disposed in a first basic surface area region, which serves for being wrapped around the first container part instead of the second container part. In the case of the label being proposed here, the course of the weakening line or lines for separating the label into the first and the second label section does not follow the geometry of the connection location between vessel body and vessel cover of commercially available medication containers having rotation symmetry, but rather deviates from it. In particular, here the spare label is part of the label as a whole, which is positioned within the basic surface area of the label in such a manner that the course of the weakening line or lines disposed between the two label sections deviates from the course of the boundary between the circumference surfaces of the two container parts. The spare label positioned and/or dimensioned within the label as a whole in this manner therefore "displaces" the separation line normally configured in the basic surface area of the label, as a straight line or in circular form after the label is dispensed, which line surrounds the ring-shaped transition between main body and closure part of common medication containers having rotation symmetry, and along which line division of the label into two parts or label sections normally takes place otherwise, because at least conventionally, a spare label is usually disposed only on one side of such a separation line or weakening line, which is supposed to serve as a later planned tear line. The spare label of the label proposed here is, however, intentionally structured in such a manner that the spare label, which is intended to remain on the second container part, namely with its first sub-section, comes to lie on top of the circumference surface of the first container part instead of on the second container part. At the same time, the entire spare label belongs to the second label section, i.e. it is delimited from the first label section by means of one or more suitably configured separation lines or weakening lines, in such a manner that when the label as a whole is torn apart during opening of the two-part container, it remains adhering or attached to the second container part, i.e. is separated from the first container part then, at the latest. The first part or surface area section of the spare label, which was previously located on or in any case above the circumference surface of the first container part, is then released from the first container part and projects beyond the separated second container part in the axial direction.

This first part of the spare label can then be used as a grip tab. On the unopened container, however, it could not be gripped before, in the inner part of the basic surface area of the label as a whole.

Depending on which wrapping region is adhesively affixed first, the first sub-section of the spare label, on the unopened container, is at first disposed to be visible above the first label section, or covered, i.e. hidden by the first label section. The first sub-section is not only separated from the first label section when the vessel is opened, in that corresponding weakening lines tear open, but rather it is, at the same time, also pulled out of the first label section or pulled off it in the axial direction. This is because the first sub-section of the spare label, specifically, preferably the entire first sub-section, of the spare label projects into the first label section or is disposed in the first basic surface area region of the label as a whole, for being wrapped around the first container part, this first sub-section is necessarily pulled off the first container part or pulled out of the first container part when the container closure is pulled off. This happens, in the case of the label proposed here, without any additional effort and without any additional manual actions, i.e. automatically during the unavoidable pulling movements or other movements that are required for separation of the second container part (closure) from the first container part (main body), for example if a protective cap is pulled off a syringe or off an injection pen. Therefore no additional, separate handling step on the part of the user of the labeled container is required, any longer, for exposing the first sub-section of the spare label that can be used as a grip tab.

The exposed or, in any case, pulled-off first sub-section of the spare label forms a projecting edge on the second container part; this projection is preferably dimensioned in such a manner that it, just like the second section of the spare label, can also carry suitable inscription parts or data, which make it possible to use the spare label as a documentation label. The first sub-section of the spare label therefore serves as a grip tab, in order to pull the spare label off the second container part or off a remaining part of the second label section that adheres to it, and use it elsewhere. The spare label can subsequently be adhesively affixed to a patient record or another documentation record, for example in order to document first-time administration of the medication liquid and, if applicable, the time point of administration, the type, composition and/or concentration of the administered medication, a serial number or some other information.

By means of removing the first sub-section of the spare label when the container is opened, a recess or gap is simultaneously formed in the indentation of the first label section, which is already sketched out in the non-divided label, by the weakening line between the two label sections. As soon as the container is opened and the label or its material ply has been torn apart, the surface area region of the first label section, which was previously covered, lies underneath and has been removed, becomes visible at the previous position of the first sub-section of the spare label that has been removed. This part is preferably structured as a functional region, for example as a clearly visible proof of first opening, or, in any case, a display field for the open state of the container.

The medication container, once it has been opened, can easily be differentiated from factory-new, unopened containers, even if it closed again later, because after removal of the spare label, the first label section of the latter is missing on the first container part and there, the surface area of the functional region is exposed, instead. At least if the container was adhesively wrapped in such a manner that the functional region was at first covered by the spare label, a noticeable change occurs on the labeled container circumference. In this way, the present invention even more effectively combines a new type of accommodation of a spare label with improved protection against product counterfeiting and against confusion between used and unused medication containers.

The label is structured as a wrap-around label, in which at least the first container part is circumferentially completely covered more than once, and thereby the label overlaps with itself on the outer circumference of the container part, i.e. comes to lie on itself. Therefore the first sub-section of the spare label and the functional region are accommodated in the two surface area sections that overlap one another. The functional region can be structured, for example, as a means of proof of first opening, as a sensor region for a parameter, or merely as an inscription or color marking for easily distinguishing the already opened container. The container can also be adhesively wrapped in such a manner that vice versa, the functional region covers the first sub-section of the spare label, so that the latter is pulled out from under the functional region when the container is opened. In both cases, in any case, an unexpected change occurs in the appearance of the label adhering to the container or of its visible individual parts that occur.

The label proposed in this application has the further advantage that it can be produced from only a single material ply. This material ply can, of course, be a material composite, which comprises, aside from a plastic film, if applicable composed of multiple film layers, also adhesive layers, adhesive neutralization layers or other anti-adhesion layers, printed layers—particularly ink layers and/or inscriptions that are imprinted or otherwise applied—or sensor layers having suitable chemicals. However, a single, uniform punch pattern is sufficient for the label, in order to punch the label as a whole out of the single material ply or material web. In particular, it is not necessary to punch surface area pieces out of different material webs for the spare label or for one of the two label sections, and to adhesively apply these to one another. Preferably, the label therefore consists of precisely one material web and is therefore a one-ply label. Further preferred embodiments are contained in the other claims, in the figures, and in the following figure description. The characteristics already discussed herein up to now can be applied to any of the exemplary embodiments of the figures and claims described below, both individually and in combination.

In concrete terms, FIG. 1 shows a schematic top view of a label 10 according to a first embodiment. The top or outer side 10*a* of the label is shown. It lies exposed on the outside even after having been dispensed onto a container. The label 10, just like in the case of all the embodiments of this application, can be produced from only a single material web 100, i.e. it particularly has only a single plastic film 101 or, alternatively, only a single paper web, wherein this plastic film 101 or paper web is provided, in certain regions, with adhesive layers, anti-adhesion layers and/or imprinted regions, as well as other coatings structured as functional regions. The label 10 as a whole can nevertheless be punched out from a material web in a single punching process, in total, and thereby possesses a uniform punch pattern; only a backing layer underneath the carrier web or the label can be provided in addition, as is usual for all labels, from which layer the label 10 is lifted off during dispensing. However, the backing layer does not belong to the actual label 10. The outer side 10*a* of the label 10, shown in FIG. 1, simultaneously reproduces the basic surface area G of the label, i.e. of the punched-out material web piece. The label 10 is shown in FIG. 1 with such an orientation that it can be wrapped around the outer surface of a multi-part, particularly two-part container, which lies horizontally (see FIG. 2). Such a container, as it is used in medicine for pharmaceuticals, medication solutions or other liquids, possesses an axial main direction a and, on the basis of its rotation symmetry, a respective circumference surface on its first and second container part. The first container part can be a main body, for example, which encloses the container contents; for example a syringe, an injection pen or a vial. Fundamentally, however, every suitable container or other article can have such a label adhesively applies around it. The second container part can be a cap, a lid or another closure element for the first container part. The single material web 100 of the label can, alternatively, also be a paper web instead of a plastic film 101; this also holds true for all the other figures and other exemplary embodiments of this application.

The first direction x along which the label 10 extends corresponds to the axial direction a, and the second direction y along which the label 10 extends corresponds to the circumference direction of the outer surface of the article. By means of the label according to any desired embodiment of this application, the transition between two container parts, in particular, is adhesively covered and thereby the closed original state of the container is ensured until it is opened for the first time. Fundamentally, applications of the labels described here for containers that do not have rotation symmetry, but rather are block-shaped, for example, are also conceivable, but the label according to the embodiments of this application is preferably intended for containers that have rotation symmetry on their outer surface or their outer circumference, particularly containers for storing, administering, withdrawing and/or accommodating a medication or a medication solution or some other liquid.

In FIG. 1, the label 10 is positioned in such a manner that the boundary line or edge of the label 10 runs at the position x1; this edge adhesively covers the transition between the first container part and the second container part on the container. Syringes, vials, injection pens, and other medication containers often have approximately the same outside radius or outside diameter of both container parts at this transition, wherein a radius change or a constriction can also be present at certain points at the transition between the two container parts, which change or constriction is bridged by the label. In the case of one-part containers, which are to be divided into two container parts, however, as intended, such as break-apart ampoules, the diameter on both sides of the planned breaking point is identical, of course.

In FIG. 1, a first basic surface area region G1 extends between the positions x1 and x3, which region is intended to be wrapped around a first container part, for example a main body of one of the medication containers mentioned above. At least in this first basic surface area region G1, the label is configured as a wrap-around label, specifically for being adhesively wrapped around a first container part completely more than once around. Along the second direction y, which corresponds to the wrap-around direction or circumference direction U, the label 10 possesses, in the first basic surface area region G1, at least a first wrapping region U1 for the first, complete wrap of the label around at least the first container part, as well as a second wrapping region U2 for the second wrap, which no longer needs to be complete, i.e. does not need to run around the container over 360°. As a result of the second wrapping region U2, the label comes to lie on itself again in the region of the first container part, i.e. it overlaps itself.

The second basic surface area region G2, which is intended to be wrapped around, but at least to partly run around and cover the second container part, is situated between the positions x0 and x1; for example, to be adhesively applied to a cap, a lid or some other container closure. The first and the second basic surface area region G1, G2 are predetermined by the design of commercially available cylindrical or circular-cylindrical, conical or otherwise shaped medication containers, around which a wrap-around label can be wrapped, as intended, and are therefore separated from one another by means of a straight line that runs at x1 (vertically in FIG. 1).

In the case of a conventional label, the planned tear line would also run at the boundary between two basic surface area regions G1, G2, along which line the label is severed; in FIG. 1, this would be at the level of position x1. In deviation from this, the label 10 proposed in the exemplary embodiments of this application, however, is structured so that when the container around which it is adhesively applied is opened, it is instead divided into two label sections 1, 2, the boundary of which specifically does not follow the transition between the two container parts, at least in the region of the spare label.

The first label section 1 is disposed within the first basic surface area region G1, which simultaneously is also a wrap-around strip 3 to be wrapped around the first container part. The label contains a first separation line or weakening line S1, which leads into the first basic surface area region G1. According to FIG. 1, the separation line S1 comprises two separation lines, for example, that run axially between the positions x1 and x2, are spaced apart from one another, and run horizontally in FIG. 1. In practice, the distance of the two lines from one another will become smaller with an increasing distance from the coordinate x1, i.e. the two separation lines or separation line sections come closer to one another in the direction of x2. The first sub-section 21, which serves as a grip tab 36 for a spare label 20, therefore narrows or becomes smaller in width from x1 toward x2. The same preferably holds true for the exemplary embodiments of all the other figures of the application, regardless of the line progression, which is shown to be parallel. According to FIG. 1, the separation line S1 furthermore comprises a third separation line at the level of the position x2, which line connects the two separation sections mentioned above. This progression of the weakening line is only given as an example; likewise, the surface section surrounded by the separation line S1 can possess rounded corners or approximately a U shape or V shape or some other shape. In any case, the region around which the first weakening line S1 runs clearly leads into the first basic surface area region G1 and takes up a portion of the basic surface area of the first basic surface area region G1. In this basic surface area region G1, the boundary between the first and the second label section runs along the weakening line S1, which, at the same time, represents a planned tear line when the labeled container is opened, wherein the second label section 2 takes up the remaining surface area region of the label 10. In the exemplary embodiment of FIG. 1, the second label section 2 simultaneously forms the spare label 20 and does not comprise any further surface area regions here, aside from the spare label 20. The same holds true for the label according to FIG. 5. In the exemplary embodiments of FIGS. 3 and 6, in contrast, the second label section 2 also possesses further surface area regions, particularly a second wrap-around strip 4, which can also be wrapped completely, more than once, around the second container part, for example a container closure in the form of a cap or of a lid.

The first weakening line S1 in FIG. 1 divides the total surface area of the label 10 or its material web 100 into two label sections 1, 2. The first and the second label section 1, 2 are therefore those pieces of the label or of its material web 100 into which the label 10 is divided when the labeled container is opened, as intended. As a result of the first weakening line S1, a first sub-section 21 of the spare label 20, which projects into an indentation of the first label section 1 on the undamaged label, is torn out of this indentation when this happens, thereby causing a recess or gap or breach to occur subsequently. The second sub-section 22 of the spare label 20 is disposed in the second basic surface area region G2 and is therefore adhesively applied to the circumference surface of the second container part when the label is dispensed onto the circumference surface of a container.

The spare label 20 is one part and is free of weakening lines within its basic surface area. In particular, no weakening line, planned tear line or other interruption exists in or on the spare label 20, along the boundary between the first and the second basic surface area region of the spare label 20. It is true that the two sub-sections 21, 22 of the spare label 20 can have different top-side and/or underside coatings, but the plastic film 101 or, alternatively, the paper web that forms the main component of the material web 100 is not interrupted between the sub-sections 21, 22 of the spare label 20, and is also not weakened in any other way, but rather possesses an unreduced layer thickness there. The two sub-sections 21, 22 of the spare label 20 differ only in their placement relative to the positions x1, which corresponds to the position of the edge or edges of the first label section 1 that leads to the spare label outside of the spare label.

If the required pulling force for pulling the second container part off is applied, the first sub-section 21 is pulled out of the first label section 1 in the axial direction. The entire spare label 20 is then at first situated on the second container part and, afterward, can be pulled off this part for use, wherein the first sub-section 21 of the spare label forms a grip tab 26 or holding tab after having been exposed, i.e. pulled out of or, in any case, pulled off from the first label section 1. In particular, after pulling apart or severing the two label sections 1, 2 from one another, the first sub-section 21 of the spare label 20 forms a projection, i.e. a projecting part of the second label section 2. The first sub-section 21 of the spare label 20 therefore projects upward beyond the remaining part of the second label section 2 and/or beyond the container to which it has been adhesively applied or, if applicable, around which it has been adhesively wrapped. The spare label 20 can be used as a documentation label for the patient record or other documentation records, a syringe or some other article. Furthermore, the spare label can also be passed on or temporarily stored on the second container part, while the medication is already administered with the first container part. Further handling advantages for the medical personnel result from this.

The underside of the second spare label section 22 is provided with an adhesive layer 19 that can be used further after the label is pulled off from the second container part. The weakening line S1, which is configured as a perforation, punch or in some other suitable way, is structured in such a manner that when the container is opened, it tears open or tears through reliably, thereby severing the label 10 along the first weakening line S1, into the first label section 1 and the second label section 2. On the underside of the first surface area section 21 of the spare label 20, the label 10 is non-adhesive. In this way, the first sub-section 21 of the spare label 20 can be pulled out of the first label section 1 that surrounds it, in the axial direction a, i.e. tangential to the circumference surface of the labeled article. The underside adhesive layer 19 of the second sub-section 22 of the spare label 20, which is disposed outside of the first basic surface area region G1, merely needs to be sufficiently strongly adhesive so that the label 10 tears apart reliably and precisely in the first basic surface area region G1, along the first weakening line S1.

Because the label according to FIG. 1 is configured as a wrap-around label, to be wrapped around at least the first container part more than once, by means of the basic surface area region G1, the first sub-section 21 of the spare label comes to lie on or under a sub-region of the first label section 1 or its wrap-around strip 3 during dispensing; depending on whether the upper or the lower end of the label shown in FIG. 1 is adhesively applied first to the outer circumference of the first container part. The surface area section of the first label section 1 that overlaps with the first sub-section 21 of the spare label 20 in this regard can therefore be structured as a functional region 5; in particular, on its outer side, in the event that the label is first dispensed with the functional region 5 or with the wrapping region U1 that surrounds it, and only afterward the first sub-section 21 of the spare label 20, which is located in the wrapping region U2, comes to lie on this functional region 5. The surfaces of the functional region 5 and of the first spare label section 21 that face one another are preferably configured to be non-adhesive, in this regard, in order not to hinder the first sub-section 21 from being tangentially pulled off or pulled out. Any VOID regions 32, for example in the form of inscriptions with lettering such as "VOID," for example, which only become visible when the spare label is pulled off to the side, in the functional region 5 that lies underneath, can be configured there, in the functional region 5 or between it and the first sub-section 21 of the spare label, as adhesive or adhering sub-surfaces or lettering.

The functional region 5 becomes visible on the opened container by means of pulling the spare label out of the first label section 1, i.e. during the same manual action with which the container is opened, the first sub-section 21 of the spare label 20 also becomes accessible as a grip tab 26, in this regard. The functional region 5, which is exposed at the same time during this process, can be used for a great number of application purposes. For example, it can be provided with an inscription 31 or with some other ink layer 34, wherein the latter simultaneously can also be a pigment layer that serves as a sensor layer 36 for detecting or for measuring and/or indicating a parameter. The inscription, ink layer or sensor layer can, for example, serve to identify that the container has already been opened and/or used, or that its contents are possibly no longer in the original, guaranteed quality and/or sterility state.

Suitable inscriptions can also be provided on the outer surface of the spare label—both on its first and on its second sub-section 21, 22. For example, an inscription can be provided on the spare label 20, which indicates in what direction the first container part is to be pulled off from the first or that the container is still unopened. After the spare label has been removed from the labeled article, it cannot easily be replaced. Furthermore, the inscription 31 or, in any case, the surface of the functional region 5 is now visible at the circumference of the first container part, indicating the used state of the container and/or its contents, for example. In the region of the functional region 5, in particular, any desired means 33 of proof of first opening can be configured, for example an ink layer 34 or a sensor layer 36 for detecting that a temperature has been exceeded or a temperature has not been reached during prior storage, influencing the shelf life or usability of the medication, for detecting contact with the outside air, for detecting incident light or UV radiation onto the surface of the functional region 5, or for indicating a specific pH or other parameter. The functional region 5 can also have warps 35 or other elevations, which generate an audible noise when the first sub-section 21 of the spare label 20 passes over them, in order to draw the attention of the medical personnel, also acoustically, to the open state, for example in order to prevent injuries resulting from unnecessarily attempting to grasp a protective cap of an injection needle that has long since been removed. The above listing of possible uses of the functional region 5, whether below or above the first sub-section 21 of the spare label 20 on the labeled container, is not comprehensive but rather merely serves as an example.

The characteristics mentioned in the above explanations regarding FIG. 1 can be applied, individually or in combination with one another, also to any other embodiment of the figures, the claims, or the remainder of the specification.

FIG. 2 additionally shows a schematic top view, with regard to the exemplary embodiment of FIG. 1, onto the inner side 10*b* or back side of the label 10, as well as, in schematic cross-section, a container 50, the circumference surface of which has the label wrapped around or adhesively applied to it. Here, an injection pen 58 is shown as the container 50; however, the container can likewise be an ampoule, a vial or injection vial, a syringe or some other one-part, two-part or multi-part container for a pharmaceutical, a liquid or some other contents, which container is to be separated into at least two container parts mounted on one another, or in which two container parts are to be separated from one another, as intended. The container 50 comprises two container parts 51 and 52 or can, in any case, be split or separated into them, for example into a main body 61, in which the container contents are disposed, and a container closure 62, for example in the form of a cap, a lid or the like. In particular, this is a standardized pharmaceutical container, in which the transition 60 between the two container parts also runs in ring shape and possesses a uniform position x1 along the axial direction a or x along the circumference, in each instance. This axial direction a is, for example, the symmetry direction of the standardized container or other article, which has rotation symmetry, to a great extent. The label 10 is adhesively applied to the circumference surface of the first container part 51, with the back side 10*b* shown in FIG. 2, in such a manner that the edge of the first label section 1, which faces to the left in FIG. 2, i.e. the wrap-around section 3, runs around the transition 60 between the two container parts 51, 52 at the position x1. This transition 60 is the boundary, visible from the outside, between the two container parts, at which boundary these parts are moved apart from one another when the container is opened. The label 10 is adhesively applied, for example, with the edge of the first label section 1, shown at the top in FIG. 2, being applied first. After having been wrapped around the first container part 1 by the first wrapping section U1 for the first wrap-around, the label comes to lie on itself. In this regard, the second label section 2, which is located within the second wrapping section U2 for the second wrap-around, which is incomplete here, namely the spare label 20 with its second label section 22, comes to lie on the second container part 52. At the same time, the first sub-section 21 of the spare label 20 comes to lie on a backing surface 15, which is preferably configured as a functional region 5.

On the underside 10*b* of the label 10 in FIG. 2, the regions of the basic surface area G that are shown without cross-hatching are configured to be adhesive, in other words covered with an adhesive layer, for example. However, at least the first sub-section 21 of the spare label 20 is configured to be non-adhesive, i.e. without an adhesive layer on the underside, for example, or, in any case, covered with an adhesive covering or anti-adhesion layer 18. The first label section 1, i.e. the wrap-around section 3, is therefore attached to the first container part 51, whereas the spare label 20 is adhesively applied only with its second sub-section 22, specifically on the second container part 52. In this regard, the second section 22 of the spare label 20 surrounds only part of the circumference of the second container part 52, thereby also making it easier to bridge radius differences between the two container parts 51, 52, whether directly at the transition at x1 or in the axial direction at a distance from it, without producing disruptive warping in the label 10. In the second spare label section 22, notches can furthermore be formed at the edges, in order to prevent wrinkle formation even at very great radius differences between the container parts.

When the two container parts are pulled apart, the first weakening line S1 on the first sub-section 21 around the spare label 20 is torn open, and the sub-section 21, which previously rested on the functional region 5 from the outside, is stripped off from this region in the axial direction. Here, the surface area section that lies underneath, having the functional region 5, serves as a backing surface 15 for the first sub-section 21 of the spare label 20.

If it is provided that the label is, alternatively, adhesively applied with its edge of the wrap-around section 3 shown at the bottom in FIG. 2 applied first, the first sub-section 21 is also configured to be non-adhesive on the underside and on the top; in addition, however, the underside of the functional region 5 (and, of course, its exposed top) is then non-adhesive. In this second case, the first spare label section 21 is exposed first when the container closure 62 is pulled off; in the first case, in contrast, the functional region 5 is exposed; depending on whether the first functional region 5 or the first sub-section 21 of the spare label 20 lies on the outside.

The wrapping section U2 shown at the bottom of FIG. 2, for the second, incomplete wrap-around, does not need to project downward further than the spare label itself, but rather the label can, alternatively, also end with the spare label 2 or with its lower edge in FIG. 2, and at the same level with the first label section 1. Then, the wrap-around strip 3 of this section then does not go beyond the first sub-section 21 in the circumference direction, at least at one edge—here, at the lower edge. Every other embodiment of the figures, the claims, and the specification can also be modified in this manner, i.e. the spare label can be disposed at an edge or an end-side region of the label 10, located in the circumference direction of the container.

The characteristics of the first embodiment described until now can also be applied to the embodiments of the other figures; in this regard, no repetitions will occur in the following text.

FIG. 3 shows a second exemplary embodiment, in which the second label section 2 has not only the spare label 20 but also a wrap-around strip 4; the latter is connected with the wrap-around strip 3 of the first label section 1 by means of a main weakening line S0. The main weakening line S0 extends at least on one side of the spare label 20, specifically at least in the direction of the functional region 5, which will be referred to as the first functional region in the following text. On the other side of the main weakening line S0, a further functional region 7 lies opposite the first and comes into coverage with the second sub-section 22 of the spare label 20 when the second label section 2 is wrapped around the second container part 52. The further functional region 7 particularly serves as a backing for the second sub-section 22 of the spare label, which section is adhesive on the underside and releasably adhesively affixed to the further functional region 7. In addition, the second spare label section 22 is also connected with the first wrap-around strip 4 or its sub-sections on both sides by means of further weakening lines S2. When the spare label 20 is pulled off by means of the exposed grip tab 26, the further weakening lines S2 are severed. The remaining weakening lines S0 and S1 are already severed as soon as the two-part container is opened; the first sub-section 21 is exposed in this way.

The first sub-section 21 of the spare label 20, which forms the projection of the second label section 2 that projects into the first label section 1, is surrounded, in the circumference direction U or the second direction y, from both sides by the first label section 1, in the region between the positions x1 and x2. Only the second label section 2 is disposed in the region between the coordinates or positions x0 and x1, and only the first label section 1 is disposed in the region between the positions x2 and x3. The region within which the two label sections 1, 2 engage into one another lies in the center region between these two end regions. In this regard, the spare label 20 engages between two sub-sections of the first label section 1 with its first sub-section 21; the indentation or the part of the first label section 1 that is set back in the direction of x3 lies between these sub-sections.

The spare label is a label region that is to be severed from the first label section 1, as intended, and furthermore used further to adhesively apply it to another article, i.e. as a documentation label. For this purpose, the spare label must also be severed from the remaining part of the second label section 2, in any case if the latter also comprises further parts than the spare label. The first sub-section 21 of the spare label is a sub-region of the label as a whole, which region possesses a sufficiently large surface area so that it can serve as a holding tab or grip tab, i.e. which is to be grasped by hand and/or pulled off from the second label section 2 and/or from the second container part 52 by hand. The first sub-section 21 of the spare label is furthermore a sub-region of the label as a whole, which is large enough to serve as the support for an inscription, as intended. In this regard, the first sub-section 21 and its inscription can already be visible, depending on the wrapping direction, immediately when the label as a whole is dispensed, or can make its appearance only when the container is opened, i.e. severed. The comments of these last two paragraphs apply analogously also for the remaining figures and other embodiments of this application.

FIG. 3 also shows an underside anti-adhesion layer 18 or adhesive neutralization layer, which is particularly provided under the first sub-section 21 of the spare label 20, as well as along a strip having a certain tolerance width T along the main weakening line S0. The strip having the width T serves to equalize production tolerances during adhesive application to the article, with reference to the position x1. A silicone varnish can be used for the anti-adhesion layer 18; likewise also on the underside of the tear-off strip or the grip tab 26 of the spare label 20. Any of the functional elements or characteristics already listed herein up to now or still to be described below can be considered as a functional characteristic or functional element for the first functional region 5; the same holds true for FIGS. 5 and 6. The underside anti-adhesion layer 18 or its sub-regions shown in FIG. 3, under the respective surface area sections, can likewise be applied to the other figures; even if they are not shown in the drawing there.

The line sections of the two further weakening lines S2, which are shown graphically as being shorter, indicate that the further weakening lines S2 are more tear-resistant than the weakening lines S0 and S1, and therefore start to tear only when greater force is exerted or only when the spare label is manually pulled off, but not already when the two label parts 1, 2 are merely pulled apart from one another when the container is opened. The perforations along S0 and S1 therefore demonstrate fewer and/or narrower bridging regions or, depending on the embodiment, longer punch line sections between the bridge regions than the perforations along S2.

FIG. 4A shows a cross-sectional view through a two-part article (see FIG. 2) around which a label according to FIG. 3 or according to FIGS. 1 and 2 has been adhesively applied, specifically in the section plane between the positions x1 and x2. The article or its outer surface or circumference surface can be shaped to be cylindrical, particularly circular-cylindrical, or conical or in some other way, particularly in a manner so that the circumference surface can have a wrap-around label wrapped around it, i.e. can be labeled all around. In FIG. 4A, the first label section 1 or its wrap-around strip 3, wrapped around the first container part 51 and adhesively applied, as well as the first sub-section 21 of the spare label that projects into this part from the axial direction can be seen. If the entire underside of the label is provided with an adhesive layer, the subsection is also provided with an anti-adhesion layer 18 underneath, which layer is shown with cross-hatching. The first sub-section 21 of the spare label lies on the first functional region 5, which serves as a backing surface 15, and is stripped off from it tangentially, in the axial direction, as soon as the container is opened and the first weakening lines S1 tear open when this happens.

FIG. 4B shows a cross-sectional view of an article around which the label according to FIG. 3 is adhesively applied, in the region of the second container part 52, between the positions x0 and x1. There, the second sub-section 22 of the spare label is disposed on the further functional region 7 and releasably adhesively applied to the common boundary surface, at least at certain locations, by means of an adhesive layer 9. On the boundary surfaces that face one another, the label is configured in such a manner that the spare label can be released from the further functional region 7 and adhesively applied to a further article by means of the underside adhesive layer 9. Preferably, an anti-adhesion layer 8 is provided at the top on the further functional region 7. The further weakening lines S2 have a composition such that they do not yet tear open when the container is opened. Thereby they are kept intact, for the time being, as planned tear lines for manually tearing off the spare label from the wrap-around strip 4 of the second label section 2 (or, according to FIGS. 1 and 2, on the second container part 52).

For the exemplary embodiment of FIGS. 1 and 2, FIG. 4B would have to be modified to the effect that the wrap-around strip 4 is absent and the second spare label section 22 lies directly on the second container part 52. In FIG. 4A, in contrast, there is no change.

The anti-adhesion layer 8, for example a printed silicone varnish, can be optionally configured over the full area or partially, i.e. on the entire top surface area of the further functional region 7 or on part of it.

The top of the further functional region 7 only becomes visible after the spare label has been pulled off from the wrap-around strip 4 or the second container part 52 around which the strip is adhesively applied. The second functional region 7, just like the first functional region 5, can carry an inscription. However, the first functional region 5 is exposed, at the latest, when the two-part container is opened, when the spare label 20, as a whole, i.e. including its first sub-section 21, comes loose from the first label section 1 as an unavoidable consequence of the axial pulling movement or the other handling step for opening the container. The first functional region 5 is thereby exposed as soon as the projection of the second label section 2 situated on top of it, which can be used as a grip tab 26, is pulled off to the side; the second sub-section 22, in contrast, only when the spare label is manually pulled off from the second container part 52.

It is practical if the spare label runs around only a relatively small angle region in the circumference direction U, in order not to hinder its label part 22 from being lifted up and the further weakening lines S2 from tearing open due to an overly great total curvature and, as a result, overly great torsion resistance of the spare label. For example, the spare label runs around an angle range of between 30° and 120° of the total outer circumference of 360°, preferably an angle range from 45° to 90°.

The two container parts are held together by the label 10 in the delivered state, or, in any case, after being labeled, and the first functional region 5 covers the first sub-section 21 and blocks the view of the first function region 5—in any case if the film 101 of the material ply 100 is non-transparent or at least a non-transparent imprinting is provided on its outer side, in the region of the gripping surface 26, or if the material ply is a paper web, which is non-transparent in any case. When the container is opened, the lower ply is exposed, here, in particular, the first functional region 5. In the first functional region 5, an indication of cancellation or an indication of first opening can be accommodated in each of the exemplary embodiments shown in the figures; for example in the form of a suitable inscription 31, a VOID film region 32, a pigment layer or ink layer 34, a sensor layer 36 of some other means 33 of proof of first opening. The further functional region 7 can also have one of the above functional elements 31 to 36, particularly an inscription 31 or a pigment layer 34.

The underside of the first sub-section 21 of the spare label, which comes to lie on the first functional region 5, should preferably be non-adhesive, i.e. free of adhesive on the underside, and should have an underside anti-adhesion layer, adhesive covering or adhesive neutralization layer, for example. Nevertheless, sub-surfaces of the first sub-section 21 can optionally be adhesive on the underside or, in any case, can be adherent, as long as lateral sliding of the sub-section 21 as a whole over the first functional region 5 and tearing open of the weakening lines S1 when the two container parts 51, 52 are pulled apart is not impaired. For example, lettering such as "VOID," for example, or other irreversible indications of first opening can be configured on the underside of the first sub-section 21 and/or on the top of the first functional region 5, using local adhesive regions or adhesive applications or other intermediate layers that are adhesive on both sides. After the two-part container around which the label is adhesively applied has been opened, and the spare label 20 has been removed from the second container part 52 and used elsewhere, as intended, the previous covering on the first functional region 5 is absent, and also on the further functional region 7, if it is present, depending on the embodiment, specifically even if the two-part container is later closed again, i.e. put together.

All of the above explanations regarding FIGS. 3 to 4B apply in the same manner also to the exemplary embodiments of the other figures, claims, and specification parts.

FIG. 5 shows a third exemplary embodiment of a label to be wrapped more than twice around at least a first container part. Accordingly, the basic surface area G of the label 10 comprises two wrapping regions U1, U2 for a complete wrap around the entire circumference of 360° of the container, in each instance, as well as a third wrapping region U3 for a further wrap, preferably only in part, around the container.

A second functional region 6 is accommodated in the third wrapping region U3, wherein the first sub-section 21 of the spare label 30, which can be used as a grip tab 26, is now disposed within the basic surface area G of the label, between the first functional region 5 and the second functional region 6. When the label is wrapped around the first container part 51, the first functional region 5, the first sub-section 21, and the second functional region 6 come to lie on top of one another—in this sequence or the opposite sequence; depending on whether the label is adhesively applied around the container starting with the section U1 or U3 first.

FIG. 5 shows the top view of the outer side 10*a* of the label 10. The second functional region 6, however, the position of which, within the basic surface area G of the label 10, is also shown in FIG. 5, is situated on the opposite inner side 10*b* or underside of the label 10. The first functional region 5, in contrast, is disposed on the outer side 10*a*. The two functional regions 5, 6 therefore face the first sub-section 21 of the spare label 20 (and, after the latter has been pulled out, face one another), in the dispensed label. If, alternatively, the label is configured to be wrapped around starting with the wrapping region U3 that surrounds the second functional region 6 being applied first, the second functional region 6 is disposed on the outer side, and the first functional region 5 is disposed on the inner side. In both alternative cases, however, the functional regions 5, 6 are situated on opposite surfaces 10*a*, 10*b* of the label 10 or of the material web 100.

In the first functional region 5, characteristics or elements 31 to 36 can be provided, as they have already been listed for the functional region 5 of FIGS. 1 to 4B. However, the design of the label 10, with three wrap-around sections U1, U2, U3, and, accordingly, with two functional regions 5, 6 that are stacked one on top of the other, offers even more possibilities with regard to the design of the functional regions 5 and 6. Specifically, if the container is opened and the first sub-section 21 of the spare label 20 between the functional regions 5, 6 is pulled out, these are no longer separated from one another and/or come into contact with one another. For this reason, two-component indicator systems can be configured in the label 10, wherein the first functional region 5 has a first indicator component K1, and the second functional region 6 has a second indicator component K2, for example. Furthermore, it is also possible to structure the second functional region 6 or the entire wrapping region U3 as a transparent viewing window for observing the first, lower functional region 5. Also, because of the additional third wrapping region U3 of the material web in the region of the second functional region 6, the sub-piece 21 of the spare label 20, once it has been pulled out, can no longer be easily introduced into the slit between the wrap-around regions U1 and U3, without producing visible tear-open traces or buckling, which remain visible through the transparent functional region 6, if applicable, or the transparent wrap-round section U3. In this way, yet another proof of first opening is created. For the remainder, reference is made, with regard to FIG. 5, to all the explanations relating to FIGS. 1 and 2, particularly since the label of the first embodiment also has the wrap-around sections U1 and U2 as well as the spare label 20.

FIG. 6 shows a fourth embodiment of a label that not only also comprises the third wrapping region U3, but in which—as in the second exemplary embodiment according to FIG. 3—the second label section 2, which serves to be applied to the second container part 52, also comprises a second wrapping section 4 in addition to the spare label 20. In this regard, not only the characteristics and explanations of the first and the third exemplary embodiment (FIGS. 1 and 2 as well as 5), but also those of the second exemplary embodiment (FIG. 3) can be applied to FIG. 6. In contrast to FIG. 3, however, the second wrapping region U2 is sufficiently long so that it can be wrapped completely around; at least in the region of the first label section 1. Furthermore, a third wrapping region U3 is provided. The second sub-section 22 of the spare label 20 is not covered by a third wrapping region U3 if later, it is supposed to be possible to pull it off not axially between the further weakening lines S2, but rather outward. Nevertheless, FIG. 6 can also be modified to the effect that the wrapping region 4 of the second label section 2 also comprises a third wrapping region, which comes to lie on the second spare label section 22. The covered spare label must then be pulled out in the axial direction or pulled off from the second container part parallel to the weakening lines S2.

In deviation from FIG. 6, the second wrapping section 4 can be provided in the first wrapping region U1 without a specially designed further functional region 7 to be configured, or can be eliminated entirely. For the remainder, the boundary lines between the wrapping regions U1, U2, and, in part, also U3, indicated in the previous figures, are not necessarily expressly marked on the label 10; however, they result from the custom-tailored production of the pharmaceutical label for the respective standardized pharmaceutical container 50, such as the ampoule 55, the vial 56, the syringe 57 or the injection pen 58.

FIG. 7 shows a schematic, cross-sectional view of a label 10 adhesively applied to the outer circumference of a container 50 (here, for example, according to FIG. 6), which label is provided to be wrapped around the container 50 more than twice. The sectional view or partial view shown runs parallel to the axial direction a. In FIG. 7, on the right or on one side of the position x1, which corresponds to the position of the transition 60 between the two container parts 51, 52, the wrapping regions U1, U2, and U3 of the first label section 1 or of the first wrap-around strip 3, which regions lie one on top of the other on the outer circumference of the first container part 51, can be seen in cross-section, as can the first sub-section 21 of the spare label 20, which extends between the positions x1 and x2—in the center wrapping region U2. This sub-section lies in the first basic surface area region G1 but belongs to the second label section 2 delimited from the first label section 1 by the weakening lines, which second section is also pulled off when the container is opened and afterward remains on the cap, the lid or other second container part 52. The first sub-section 21 of the spare label 20, disposed between the wrapping regions U1 and U3, is pulled out by means of the unavoidable compulsory movement when the container is opened.

The embodiments according to FIGS. 5 and 6, intended to be wrapped around a medication container three times, can be used, for example, in order to accommodate sensors or other detection systems having two different components in the label 10, for example in that a first indicator component K1 is provided on the top in the first functional region 5, and a second indicator component K2, which reacts or is capable of reaction with the first is provided on the underside in the second functional region 6. The first sub-section 21 of the spare label is disposed between the surface area regions of the functional regions 5, 6, which face one another and are covered by the indicator components K1, K2; this sub-section separates the two components from one another as long as the labeled product or the container 50 is still unopened. Optionally, the sub-section 21 can be provided with additional layers on the top and on the underside, as shown in FIG. 7; for example with an underside coating 11 and/or a top coating 12. The underside coating 11 can be, for example, an adhesive-neutralizing layer or an adhesive cover or some other anti-adhesion layer, for example composed of silicone or a material that contains silicone. The top coating 12 can also be an anti-adhesion layer or, in any case, a friction-reducing layer composed of silicone or a material that contains silicone, in order to make the non-adhesive top of the first sub-section 21 even smoother and to further reduce the friction when the first label section 21 is pulled out. Furthermore, the second functional region 6 is also non-adhesive on the underside.

Alternatively, however, it can also be provided that one of the layers 11, 12 or both of them are structured in such a manner that their surface possesses greater roughness than the film 101 or the paper of the spare label or than the remaining material ply 100 of the label 10. For example, a chemical reaction between the two indicator components K1, K2 can be initiated by means of a short-term temperature increase, which occurs when the first label section 21 is pulled out, as the result of the friction heat. In this case, the surfaces of the first sub-section 21 of the spare label 20 serve as friction surfaces, heating surfaces or ignition surfaces. Instead of or in addition to a temperature-increasing effect, the mere mechanical friction when the spare label is pulled out can also be used to get a reaction going between the components K1, K2, for example in that ink pigments or substances of one or both components K1, K2, encapsulated in protective capsules, are released by the friction generated when the first sub-section 21 is pulled out, in that the protective capsules are crushed and/or torn out. In this way, the two components K1, K2 can actually be disposed in the same functional region, for example the lower functional region 5, because only the friction during the pull-out process damages, destroys or, in any case, opens the capsule sheaths between the two components K1, K2. The third wrapping region U3 then serves merely to ensure sufficiently strong compression between the underside friction surface 11 of the spare label 20 and the top functional region 5 underneath it.

In order for an immediate reaction that is already completed after a few seconds or minutes not to occur after the spare label section 21 has been removed, the indicator components K1, K2 or one of them can be provided with thin barrier layers or cover layers, which dissolve when they make contact with other components and thereby only gradually permit a chemical or other reaction between the two components K1, K2. Furthermore, an indicator component can be coated with a barrier layer that influences the time-dependent and/or temperature-dependent reaction with the second indicator component after contacting. Such barrier layers for time indicators and/or temperature indicators are described in WO 91/06853, for example. For example, the start and time progression of the reaction of the two indicator components can be controlled relatively precisely by means of the selection and thickness of the material for the barrier layer.

Furthermore, the functional regions 5, 6 that are provided with the indicator components K1, K2, or one of them, can be configured as layers having a temperature behavior similar to that of wax, i.e. as a layer that melts or becomes liquid or capable of flow only above a certain limit temperature or, in any case, only above room temperature, and only afterward permit a reaction between the indicator components. Possible chemical reactions for the alternatives for two-component indicator systems named in this application can be acid/base reactions, for example, particularly those that are connected with a change in color. For example, phenolphthalein and sodium hydrogen carbonate can be used as indicator components K1 and K2, for example in order to produce a color change from colorless to red.

The indicator components K1 and K2 can also be structured as follows. The first indicator component can be a metal layer or a layer that contains metal or a metallized film layer, preferably composed of a polymer film. The metal can be one of the metals aluminum, copper, silver, iron, magnesium, tin, chromium, zinc, nickel, titanium or an alloy of these aforementioned metals. The thickness of the metal layer amounts to 1 nm to 1 mm, preferably 5 nm to 0.5 mm.

The second indicator component can be a doped polymer layer, wherein the doping substance is an acid, a base or a salt. The polymer can also be functionalized with an acidic or basic group or can be functionalized with latently acidic or latently basic groups, for example with photolatent acids or photolatent bases that release the acid or base when irradiated with light.

Such indicator components are known and described in WO 2008/083926, for example. Activation of the time indicator and/or temperature indicator takes place by means of full-area contacting of the first indicator component with the second indicator component, after the spare label section 21 has been removed. After contacting of the two indicator components, a chemical reaction of the two reaction components with one another takes place. For example, according to one embodiment, a metal layer of the first indicator component, which particularly can be a shiny metal layer, is dissolved by the acid of the second indicator component, in time-dependent and/or temperature-dependent manner; this is detected, in terms of measurement technology, by means of detection of the changing optical (absorption, transmission, reflection) and/or electrical properties (electrical resistance), but can also be visually tracked with the naked eye, without any additional aids.

All the characteristics and embodiments listed here, with regard to the two components or one of them, are not restricted to FIG. 7 but rather can also be applied to the other figures and exemplary embodiments, particularly to those of FIGS. 5, 6, and 8 to 10.

Finally, an acoustic effect can also be produced in that optionally, the first sub-section 21 of the spare label 20, the first functional region 5 and/or the second functional region 6 are provided with geometric uneven regions, for example punched-out regions or warps in individual film regions or surface regions. For example, top and underside punched-out regions or other grooved regions can be provided in the sub-section 21 of the spare label, which run transverse to the axial direction a and by means of which the sub-section 21 gets a slightly wave-like shape—in any case, in the tension-free state, when it is not yet sandwiched in the tight interstice between the wrapping regions U1 and U3. When it is pulled out, i.e. as it slides over corresponding uneven regions of the first and/or second functional region 5, 6, an audible noise then occurs, giving acoustical feedback that opening has taken place and therefore that the medication in the container is ready for use.

The coatings 11, 12 of the spare label section 21 can also be structured in such a manner that they impart a different curvature to it than is possible in the dispensed state, between the functional regions 5, 6 and winding regions U1, U3. When the sub-section 21 is pulled out from the first label section 1 on the first container part 51, the sub-section 21 then audibly snaps into its tension-free or lower-tension form, and thereby an audible opening noise can also be produced.

According to yet another variant, the layers 11, 12 or one of them can also contain magnetic substances, particularly those that have already been pre-magnetized, i.e. possess spontaneous magnetization. Structured conductor tracks or other conductive and/or magnetic structures can also be imprinted or otherwise provided on the sub-section 21 of the spare label and/or on one or both functional regions 5, 6. When the spare label section 21 is pulled out, a short-term induction current then occurs, which is detected by a small sensor on the adhesively wrapped container, for example, and can be displaced by means of an LCD display, a diode or some other means of display of the article itself, or can be read out in some other manner. For example, an injection pen can have a sensor below the circumference surface region over which the first spare label section 1 is to be applied.

Instead of two-component sensor systems, one-component sensors, for example as a sensor layer only in the first, lower functional region 5 can also be used, whereas the second functional region 6 in the wrapping region U3 is used merely as a transparent viewing window, if applicable with its own inscription. In this regard, the layers 6 and 12 in FIG. 7 can be eliminated, depending on the embodiment.

In particular, FIGS. 8 to 10 show some exemplary embodiments in this regard. The regions that are disposed within the first basic surface area region and come to lie on top of one another when adhesively applied to the first container part are shown, in each instance, namely the first functional region 5 in the wrapping region U1, the first sub-section 21 of the spare label in the wrapping region U2, and the second functional region 6 in the wrapping region U3.

According to FIG. 8, the material ply 100, i.e. the plastic film 101 is transparent, and at least in the second functional region 6, the film is free of non-transparent, full-area imprinting. The second function region 6 thereby serves as a viewing window 30 for observing the label region that lies underneath it, wherein the second functional region 6 can optionally have an inscription 31. Underneath this region, the first spare label section 21 is visible in the unopened state, which section is constructed in a first color (green, for example). As soon as this section is pulled out, the first functional region 5 becomes visible underneath it, which is constructed in a different color (red, for example) than the first spare label section 21 and/or can contain a different inscription 31; for example a strike-out that is optically superimposed on the text of the inscription 31 of the top, second functional region, and thereby indicates that the product in the open container is no longer sterile. For this purpose, suitable lettering such as "sterile," for example, can be provided in the viewing window 30 or as an inscription 31 in the second functional region 6, for example, and a strike-out of the lettering can be provided in the lower, first functional region 5, in the same position.

FIG. 9 shows a schematic top view relating to the embodiment from FIG. 7. According to FIG. 9, two indicator components K1, K2 are provided in the surface area region of the functional regions 5 and 6 or a part of these. For the remainder, reference is made to FIGS. 5 to 7.

FIG. 10 shows a further example in which the viewing window 30 is not inscribed and instead, the first functional region 5 has the actual inscription 31. In this regard, this can be, for example, an identification key or identification code for the label or for the product around which it is adhesively applied, for example a code that can be input and/or called up via the Internet or email, which, when compared with the manufacturer's information, can verify the authenticity of the label 10 or of the product or container 50 around which it is adhesively applied. Such an inscription 31 thereby serves as a means 33 of proof for first opening; alternatively or in addition, ink layers 34, a VOID film region 32 or a sensor layer 36 can be provided as further means 33 of proof of first opening.

In the first functional region 5, every suitable means of proof of first opening or other means of proof, for example for indicating the shelf life, the aging state of a medication or the storage period or period of use that has already elapsed can be provided. In this way, irradiation with light or UV rays, contact with ambient air, the fact that a temperature was exceeded or not reached during storage or after the container was opened, or some other effect can be indicated. Depending on the embodiment, it can be practical, in this regard, to structure the second functional region 6 to be transparent or non-transparent. Each of the means of proof listed here with reference to FIG. 10 can also be provided for one of the components K1, K2 or both from FIG. 7 or 9.

In all the embodiments of this application, even if shown differently, the first sub-section 21 of the spare label 20 can preferably be slightly narrower at its end at the positions x2 than at the position x1, i.e. the spare label section 21 narrows all the more, the further it projects into the first label section 1. As a result, it can be pulled out more easily and without damage. A trapezoid geometry of the first spare label section 21, for example, allows more precise control of the intensity of the friction and/or retention force that occurs when it is being pulled out, without mechanical warping or even tears along the first weakening line S1 occurring. By means of suitable shaping of the basic surface area of the spare label section 21, the latter can be reliably pulled out without being damaged.

Furthermore, the holding force of the weakening lines S2 is coordinated with the holding force of the weakening lines S1 and, if applicable, also S0, and, if applicable, additionally also with the adhesive force of the underside adhesive layer 9 of the second sub-section 22 of the spare label 20. In particular, the holding force of the weakening lines S2 is dimensioned in such a manner that when the second label section 2 is pulled off from the first label section 1 on the container to which the label is adhesively applied, the first weakening line S1, which surrounds the first sub-section 21 of the spare label 20 and, if present (FIGS. 3, 4, and 7), at the same time also the main weakening line S1 between the respective wrap-around strips 3, 4 of the label sections 1, 2 tears open, whereas the further weakening lines S2 remain undamaged. The further weakening lines S2 are therefore only severed later, namely when the spare label 20 is manually pulled off from the second container part.

For the remainder, the front of the labels shown in FIGS. 1, 3, 5, and 6 is preferably provided with inscription parts, particularly in the form of imprinting. However, the inscriptions are not specifically shown in the figures.

REFERENCE SYMBOL LIST

1 first label section
2 second label section
3, 4 wrap-around strip
5 first functional region
6 second functional region
7 further functional region
8 anti-adhesion layer
9 adhesive layer
10 label
10*a* outer side
10*b* inner side
11 underside coating
12 top coating
15 backing surface
18 anti-adhesion layer
19 adhesive layer
20 spare label
21 first sub-section
22 second sub-section
26 grip tab
30 viewing window
31 inscription
32 VOID film region
33 means of proof of first opening
34 ink layer
35 warp
36 sensor layer
40 medication
45 liquid
50 container
51 first container part
52 second container part
55 ampoule
56 vial
57 syringe
58 injection pen
60 transition
61 main body
62 container closure
100 material web
101 plastic film
a axial direction
G basic surface area
G1 first basic surface area region
G2 second basic surface area region
K1 first indicator component
K2 second indicator component
S0 main weakening line
S1 first weakening line
S2 further weakening line
T tolerance width
U circumference direction
U1, U2, U3 wrapping region
x first direction
x0, x1, x2, x3 position
y second direction

The invention claimed is:

1. Label (10) for a container that is in multiple parts or can be divided into multiple parts, for storing, administering, withdrawing and/or accommodating a medication and/or a liquid, wherein the label (10) has precisely one material web (100), which contains a first label section (1), which is intended to be attached to a first container part of a container, and a second label section (2), which is intended to be attached to a second container part of the container, wherein the label (10) is a wrap-around label to be wrapped completely around at least a first container part, more than once, wherein the first label section (1) is intended to be wrapped around the first container part, wherein the second label section (2) comprises a spare label (20), which can be removed and adhesively applied to a further article, and is configured in the material web (100) and has a first sub-section (21) and a second sub-section (22), wherein the first sub-section (21) of the spare label (20) projects into the first label section (1), whereas the second sub-section (22) of the spare label (20) and/or another part of the second label section (2) is intended to be attached to a second container part, and wherein the label (10) is configured in such a manner that when the first and the second label section (1, 2) are pulled apart to open a container around which the label (10) is adhesively applied, the first and the second label section (1, 2) tear apart from one another, and the first sub-section (21) of the spare label (20) becomes accessible as a grip tab (26) for pulling the spare label (20) off a remainder of the second label section (2) and/or off the second container part.

2. Label according to claim 1, wherein the label (10) has a first weakening line (S1) between the first sub-section (21) of the spare label (20) and the first label section (1).

3. Label according to claim 1, wherein in a first direction (x), which predetermines an axial direction of a container around which the label (10) is to be adhesively applied, the first label section (1) ends at a first position (x1), whereas the spare label (20) possesses an expanse in the first direction (x) that extends to both sides of the first position (x1), wherein the first sub-section (21) of the spare label (20) projects into the first label section (1), starting from the first position (x1), all the way to a second position (x2).

4. Label according to claim 3, wherein in the region between the first position (x1) and the second position (x2), the spare label (20) is surrounded by the first label section (1), on one side or on both sides, along a second direction (y) that faces perpendicular to the first direction (x).

5. Label according to claim 1, wherein the first sub-section (21) of the spare label (20) is configured to be non-adhesive on the top and the underside, and wherein the second label section (2) is structured in such a manner that the second sub-section (22) of the spare label (20) can be or is releasably adhesively applied to a wrap-around strip (4) of the second label section (2) or to a second container part of a multi-part container, wherein the second sub-section (22) of the spare label (20) is configured to be adhesive on the underside.

6. Label according to claim 1, wherein the first label section (1) has a first surface area section (5) that is positioned and/or dimensioned within the first label section (1) in such a manner that the first surface area section (5) of the first label section (1) and the first sub-section (21) of the spare label (20) come to lie on top of one another when wrapped around a container.

7. Label according to claim 6, wherein the first surface area section (5) of the first label section (1) is non-adhesive on the top, and wherein the first sub-section (21) of the spare label (20) is non-adhesive on the underside.

8. Label according to claim 6, wherein the first surface area section (5) of the first label section (1) has an inscription (31), a VOID film region (32), an ink layer (34), a means (33) of proof of first opening, punches and/or mechanical warps (35).

9. Label according to claim 6, wherein the first surface area section (5) of the first label section (1) has a sensor layer (36), wherein the sensor layer (36) is a sensor layer for detecting incident light or UV radiation, contact with ambient air, for detecting that a temperature has been exceeded or has not been reached, or a sensor layer for indicating the shelf life or the aging state of a medication or a storage period or period of use that has elapsed.

10. Label according to claim 6, wherein the label (10) is a wrap-around label to be wrapped more than twice around at least a first container part of a container, by means of the first label section (1), and wherein the first label section (1) furthermore has a second surface area section (6) that is positioned within the first label section (1) and/or dimensioned in such a manner that when it is wrapped around a container, it covers a first sub-section (21) of the spare label (20) that covers the first surface area section (5).

11. Label according to claim 10, wherein the first surface area section (5) and/or the second surface area section (6), as a whole, have two indicator components (K1, K2), which enter into a chemical or other reaction with one another when they are brought into contact with one another and/or heated, released or otherwise activated by means of a friction movement on the first sub-section (21) of the spare label (20).

12. Label according to claim 1, wherein the label (10) is a wrap-around label to be wrapped around both a first container part and a second container part of a container, more than once, wherein the second label section (2) has a wrap-around strip (4) to be wrapped around a second container part, and wherein the second sub-section (22) of the spare label (20) is integrated into the wrap-around strip (4) of the second label section (2), wherein the first sub-section (21) of the spare label (20) projects out of the wrap-around strip (4) of the second label section (2) in the direction of the first label section (1), and wherein the part of the wrap-around strip (4) that is situated outside of the surface area of the spare label (20) is connected with the first label section (1) by means of a main weakening line (S0).

13. Label according to claim 6, wherein the second label section (2) has a further surface area section (7) that is disposed at the level of the first surface area section (5) and/or that possesses the same distance from the second sub-section (22) of the spare label (20) as the distance of the first surface area section (5) from the first sub-section (21) of the spare label (20).

14. Label according to claim 13, wherein the further surface area section (7) has an anti-adhesion layer (8) on the top, over its full area or on part of its surface area, on which layer an underside adhesive layer (9) of the second sub-section (22) of the spare label (20) comes to lie when the label (10) is wrapped around a container.

15. Label according to claim 1, wherein the label (10) is a single-ply or multi-ply label having precisely one material web (100), wherein the material web (100) has a plastic film (101) or paper web, in which the first label section (1) as well as the second label section (2), including the spare label (20), are configured.

16. Container (50), comprising at least a first container part (51) and a second container (52), wherein the container (50) has a label (10) according to claim 1 adhesively applied around it.

17. Container according to claim 16, wherein the container (50) is a container suitable for having a wrap-around label wrapped around it, the first container part (51) of which can be filled or is filled with a liquid (45), a medication (40)

and/or some other contents, and the second container part (52) of which is a container lid, a container cap or some other container closure (62) that can be pulled off from the first container part (51).

18. Container according to claim 16, wherein the container (50) is a vial (56), a syringe (57), an injection pen (58) or some other at least two-part container for storing, administering, withdrawing and/or accommodating a medication and/or a liquid.

19. Container according to claim 16, wherein the container (50) is an ampoule (55) that can be broken open or some other container that can be divided into multiple container parts (51, 52), as intended, having a planned breaking point.

20. Container according to claim 16, wherein the first container part (51) has the first label section (1) wrapped around it, and wherein the second label section (2) is attached to the second container part (52), wherein the first sub-section (21) of the spare label (20) is disposed in the region of the outer circumference of the first container part (51).

* * * * *